US007673642B1

(12) United States Patent
Shires

(10) Patent No.: US 7,673,642 B1
(45) Date of Patent: Mar. 9, 2010

(54) SINGLE POLE FREESTANDING SHELTER

(76) Inventor: Henry C. Shires, 330 Belmont Ave., Redwood City, CA (US) 94061

( * ) Notice: Subject to any disclaimer, the term of this patent is extended or adjusted under 35 U.S.C. 154(b) by 259 days.

(21) Appl. No.: 11/162,302

(22) Filed: Sep. 6, 2005

(51) Int. Cl.
*E04H 15/36* (2006.01)

(52) U.S. Cl. ..... 135/136; 135/125; 135/119; 135/120.3; 135/905

(58) Field of Classification Search ..... 135/87, 135/95–96, 121–123, 124–125, 136–138, 135/156, 115, 117, 119, 120.3, 905; 224/154; 5/114
See application file for complete search history.

(56) References Cited

U.S. PATENT DOCUMENTS

| | | | | |
|---|---|---|---|---|
| 2,167,219 | A * | 7/1939 | Sankey | 135/133 |
| 2,646,057 | A * | 7/1953 | Blanchard | 135/94 |
| 3,223,098 | A * | 12/1965 | Dole, Jr. | 135/126 |
| 3,834,410 | A * | 9/1974 | Leibel | 135/123 |
| 3,943,952 | A * | 3/1976 | Marquart et al. | 135/93 |
| 4,003,181 | A * | 1/1977 | Robinson et al. | 135/115 |
| 4,102,352 | A * | 7/1978 | Kirkham | 135/97 |
| 4,285,355 | A * | 8/1981 | Lundblade | 135/147 |
| 4,404,980 | A * | 9/1983 | Wade | 135/123 |
| 4,569,362 | A * | 2/1986 | Fidler, Jr. | 135/126 |
| 4,716,918 | A * | 1/1988 | Hayashida et al. | 135/93 |
| 5,954,077 | A * | 9/1999 | Wain et al. | 135/119 |
| 6,021,794 | A * | 2/2000 | Guerra | 135/95 |
| 6,843,261 | B2 * | 1/2005 | Gillis | 135/156 |

FOREIGN PATENT DOCUMENTS

FR 2674113 A1 * 9/1992

OTHER PUBLICATIONS

Mountain Safety Research, Hubba tent, on-line catalog (www.msrcorp.com/tents/hubba.asp), Jun. 15, 2004, 2 pages, Wayback Machine (www.archive.org), U.S.
Mountain Safety Research, Hubba Hubba tent, on-line catalog (www.msrcorp.com/tents/hubbahubba.asp), Jun. 16, 2004, 2 pages, Wayback Machine (www.archive.org), U.S.
Sierra Designs, Asteroid (2002 model), online instruction manual, 2002, 1 page, www.sierradesigns.com., U.S.
Mont-Bell North America, Monoframe Shelter Diamond, website page, 2004, 2 pages, www.montbell.com, U.S.
Hilleberg, Akto, website page, 2004, 2 pages, www.hilleberg.com, U.S.

(Continued)

*Primary Examiner*—Winnie Yip
(74) *Attorney, Agent, or Firm*—Northern Michigan Patent Law, PLC

(57) ABSTRACT

A lightweight, freestanding tent type shelter using a single removable arch pole tensioning the roof canopy between ground-level platform poles that form a perpendicular base for the arch pole. The platform poles are already-carried or found pole type objects such as trekking poles, sticks, skis, paddles and the like already at hand or easily located at a campsite, and the lower side edges of the canopy are provided with connectors for securing the canopy to the platform poles. The canopy has an embedded roof strut crossing the arch pole to add headroom and transfer arch tension to the front and rear ends of the shelter.

14 Claims, 5 Drawing Sheets

OTHER PUBLICATIONS

Wikipedia; Trekking Pole; Wikipedia, the free encyclopedia; May 24, 2008; 1 page; www.wikipedia.com; U.S. (Internet).
Google; search results for "trekking poles"; Google; Dec. 26, 2007; 2 pages; www.google.com: U.S. (Internet).
Leki; Leki Trekking; Leki on-line catalog; 2004; 1 page; www.leki.com (via web.archive.org); U.S. (Internet).
John Scholefield, stage 7 saint-jean-pied-de-port to col d'irau, web page camping journal, Jul. 26, 1998, 2pp, http://user.itl.net/~coldfish/GR10/stage7.html, U.S. (internet).
Mac E, phoenix phreeranger, weblog article, Apr.l 2009 (subject dated to 1995), 17pp, http://maceachain.blogspot.com/2009/04/phoenix-phreeranger__22.html, U.S. (internet).

* cited by examiner

SINGLE POLE FREESTANDING SHELTER

BACKGROUND OF THE INVENTION

The present invention is in the field of tent and tarp type shelters used by hikers and campers.

Hikers and backpackers usually require a shelter such as a tent for overnight or multi-night trips. The longer the trip, the greater the need for a shelter of as little packed weight as possible to reduce fatigue, to make room for food and other gear in the pack, and to increase the enjoyment of hiking.

Tents tend to be one of the heaviest items in the pack. The typical modern tent is a sturdy, freestanding dome or paraboloid shelter. When two or more long, removable, sectioned poles are inserted into canopy sleeves, and tensioned into arches with the pole ends locked into the corners of a bathtub style waterproof floor to lift the canopy, the tent is "freestanding", meaning it will stand on its own without being staked down (although the tent is almost always staked down for wind security after the initial freestanding setup). The primary drawback of freestanding tents is their weight, with a minimum of two long, relatively heavy poles and a floor designed to form a structural base for the poles and arched canopy.

Some double-walled freestanding tents are offered with a "fastpack" option, in which the main tent body can be left at home while the arch poles are used to tension just the rainfly portion of the tent over a detachable floor. This arrangement is lighter than the full double-walled tent combination, but still requires multiple arch poles, and loses the protection of the insect netting of the main tent body.

Some hikers opt for lighter, non-freestanding shelters that must be staked out in order to reduce weight from their packs. Examples of non-freestanding tents include nylon pyramids, pole-supported tarps, my Tarptent™ shelters, and several single-pole hoop designs from companies such as Sierra Designs (Asteroid model), Montbell (Monoframe model), and Hilleberg (Akto model). The pyramids and tarp shelters typically use one or more relatively short, lightweight, upright poles for structural support, and even more weight can be saved by substituting an already-carried trekking pole or hiking stick for an upright pole. The single-pole hoop designs use only a single arch pole, typically bisecting the tent, and must be staked down and/or guyed out with tensioning lines for the single arch to stand unsupported.

While single-pole shelter designs are lighter, many backpackers still choose heavier multi-pole freestanding tents for their ease and speed of setup, their greater headroom, the ability to move them around a campsite fully set up, and for their generally greater structural stability.

BRIEF SUMMARY OF THE INVENTION

The invention is a shelter that is freestanding using a single arched canopy pole. The shelter comprises a weather-resistant canopy having a generally rectangular "footprint" or sheltered area underneath, a removable arch pole connected to the canopy running widthwise across the canopy, and platform connectors along lower side edges of the canopy for securing the lower side edges of the canopy to already-carried (or found) elongated platform-creating pieces such as trekking poles, sticks, ski poles, skis, and the like laid on the ground at right angles to the arch pole. The ends of the inserted arch pole are locked in place under tension, and are further connected in tension to the platform poles on the sides of the shelter.

In a preferred form the canopy has a captured or embedded roof strut that crosses the arch pole to add headroom and canopy tension. The roof strut is preferably a short, straight pole or similar member, light in weight and relatively rigid, either permanently or removably secured to the canopy so as to effectively be a part of the canopy both when stored and set up. Depending on the deployed length of the roof strut, the strut can be a telescoping member so that it can be extended for tent set up, and collapsed to a shorter length for storage while remaining embedded in the canopy when the shelter is rolled up.

In another preferred form, the shelter's canopy has an arched roof portion with front and rear edges generally defining planar front and rear end walls or doors, in a preferred form the ends being generally triangular in shape and extending from the ends of the roof strut. In a further preferred form, the canopy's front and rear edges angle inwardly from bottom to top, such that the front-to-back depth of the shelter at its peak is less than the depth of the shelter at its bottom edges, and the peak of the arch-supported canopy is connected in tension at opposing acute angles to the ends of the platform poles.

While the shelter is preferably floorless for weight savings and versatility (allowing the use of a removable groundcloth), it may also be floored without the need for the floor to form a structural base for the canopy and arch pole. And while the canopy is preferably designed to be freestanding with its lower side edges spaced above the ground, it may also essentially reach the ground by connecting the canopy side edges as closely as possible to the platform poles.

These and other features and advantages of the invention will become apparent from the detailed description below, in light of the accompanying drawings.

DETAILED DESCRIPTION OF THE INVENTION

Figure 1:
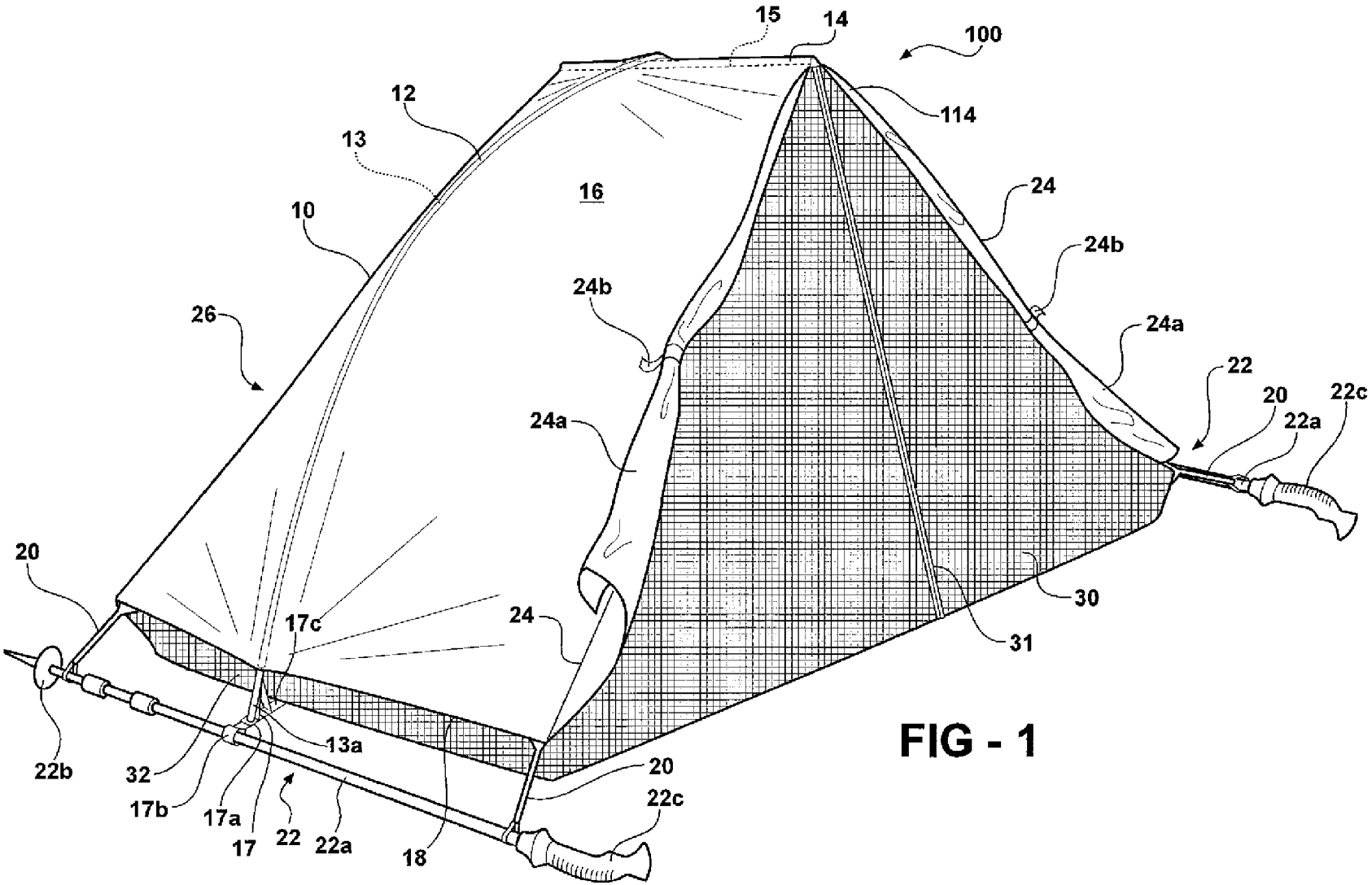
FIG. 1 is a front perspective view of a shelter according to the present invention, using trekking poles for a platform.

Referring first to FIG. 1, a preferred example of a shelter according to the invention is shown at 100, having a weather-resistant and preferably waterproof canopy 10. In the example of FIG. 1, canopy 10 is preferably made from silicone-coated or silicone-impregnated nylon, which is waterproof and very light, generally weighing less than two ounces per square yard. It will be understood by those skilled in the art that other known fabrics can be used depending on the expected conditions of use, including but not limited to polyurethane-coated nylon or polyester, wind or solar-resistant uncoated fabrics, or the so-called waterproof/breathable fabrics. Shelter 100 is a single-wall tent, meaning that the canopy is a single layer or sheet of fabric. While it is possible to make shelter 100 with double-wall construction (inner breathable canopy, outer waterproof rainfly spaced from the inner canopy by the arch pole structure), it would add unnecessary weight and complexity for most users. A single-wall canopy is accordingly preferred.

Canopy 10 has an open-ended pole sleeve 12 running widthwise across the canopy between side edges 18, over peak 14 and side panels 16. An arch pole 13 can be inserted and removed endwise in sleeve 12 in known manner. While a solid-fabric, continuous, open-ended pole sleeve is preferred, those skilled in the art will recognize alternatives such as an interrupted sleeve, a mesh sleeve, a row of pole clips, sleeves closeable at one or both ends, and others suitable for lifting the canopy in essentially continuous tension against the arched pole. The free ends 13*a* of arch pole 13 are secured in tip-locking members such as cups or grommets 17*a* secured to the lower edges of the canopy, for example by vertical nylon strap 17. Grommets 17*a* and thus the inserted pole ends 13*a* are connected in tension by a cross-strap or similar flexible connector 17*c* running along the ground under the canopy between the pole ends at side edges 18 from one grommet 17*a* to the other. The ends of pole 13 are additionally connected in tension to an intermediate portion 22*a* of platform poles 22 (preferably at or near the middle), in the illustrated embodiment by a connecting strap 17*b* extending from grommet 17*a* or strap 17*c*, looping around pole 22 and fastening to itself or to pole 13 with a known fastener such as hook-and-loop material or a clip. Connecting strap 17*b* is preferable adjustable to adjust the tension exerted on the middle of pole 22 by the arch pole, and to accommodate platform poles of different size.

Lower sides 18 of the canopy are secured to end regions of elongated platform-creating poles 22, such as the illustrated trekking poles, with strap or cord type connectors 20 located at the corners of the canopy. Trekking poles are commonly carried by hikers and backpackers, and so are generally available for use with shelter 100. If the person using the shelter does not have trekking poles, any elongated, relatively straight, rigid item of sufficient length can be used as platform poles, including but not limited to hiking sticks, tree limbs and deadwood, canoe or kayak paddles, backpack frame members, or, in winter, ski poles, skis, and even some types of snowshoe. A backpacker accordingly need not carry the weight of dedicated platform poles 22, since other items will be at hand or easily scrounged from a campsite. In the illustrated embodiment, platform connectors 20 are loops of elastic shockcord sized to fit around typical pole-type objects such as the illustrated trekking poles. While simple elastic loops as illustrated are preferred, connectors 20 can be made from other types of strap or fabric or cord, can be adjustable in length or loop size to accommodate platform poles of different diameter and shape, may be provided with universal connectors such as clips, hooks, and the like instead of loops, and could be tension-adjustable in addition to or instead of relying on elastic properties for tension. Those skilled in the art will be familiar with many known options for securing the edges of canopy 10 to platform poles 22 under tension. It may be preferred to locate connectors 20 between or within projections on poles 22, such as the illustrated basket 22*b* and handgrip 22*c*, to keep the connectors from sliding on the poles. At a minimum, the corners of the canopy are provided with platform connectors 20, with additional connectors 20 being possible although adding weight. It will be understood that in the unlikely event that platform poles cannot be found, connectors 20 can be staked to the ground to set the tent up in non-freestanding fashion with a minimum number of stakes.

Canopy 10 preferably also includes a roof strut 15 crossing the canopy from front to back along peak 14. Roof strut 15 is an embedded piece of the canopy, capable of being left in place during storage and remaining in position when the arch pole is inserted in the canopy. In the illustrated embodiment peak 14 is formed as a pole-type sleeve similar to sleeve 12, and may have an openable end to allow strut 15 to be removed for certain storage or carry situations, or for cleaning or repair or replacement. Strut 15 is preferably a short length of hollow aluminum or carbon fiber pole similar to arch pole 13, although it need not be cylindrical or hollow or made from typical tent pole material. Strut 15 provides good interior headroom at the front and rear ends of the shelter, and results in better canopy tension at the front and rear wall edges 24 and 26. For larger shelters with greater front-to-back dimensions needing longer roof struts, strut 15 could be made to telescope or otherwise collapse or shorten for improved packability when the shelter is taken down.

Figure 2:
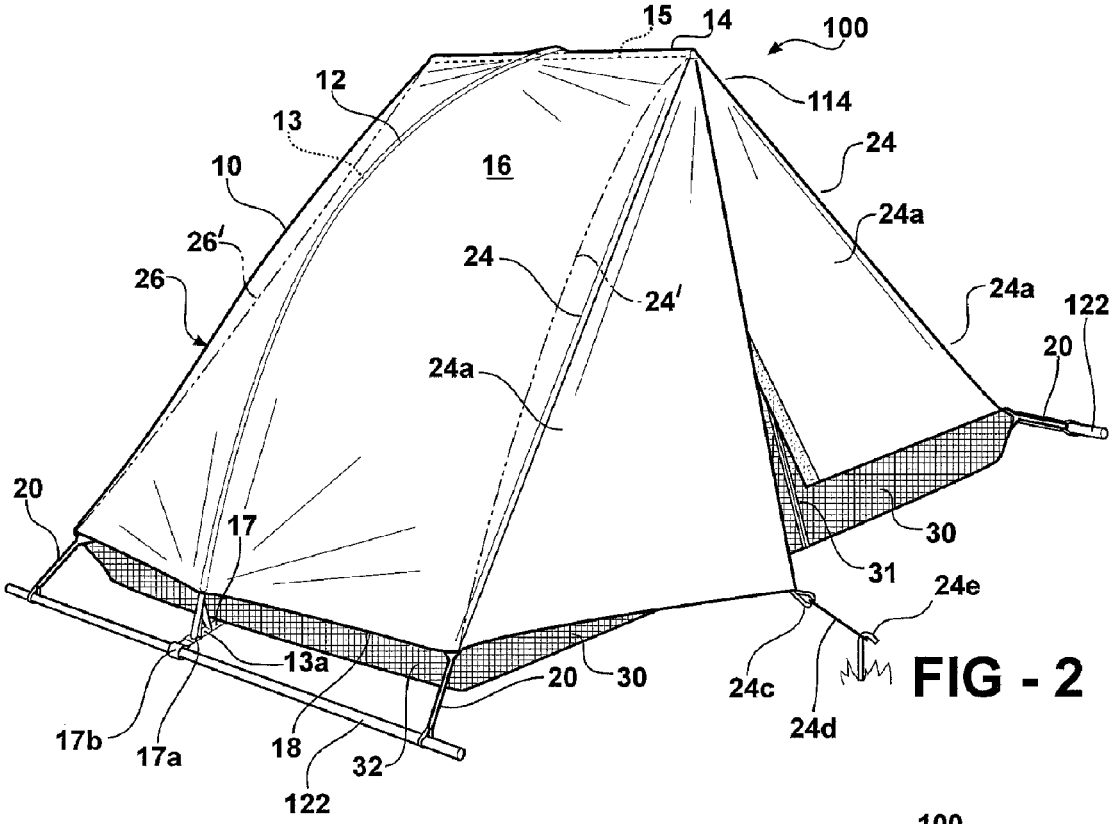
FIG. 2 is similar to FIG. 1, but with its front weather door closed and with generic sticks or poles for a platform.
Figure 3:
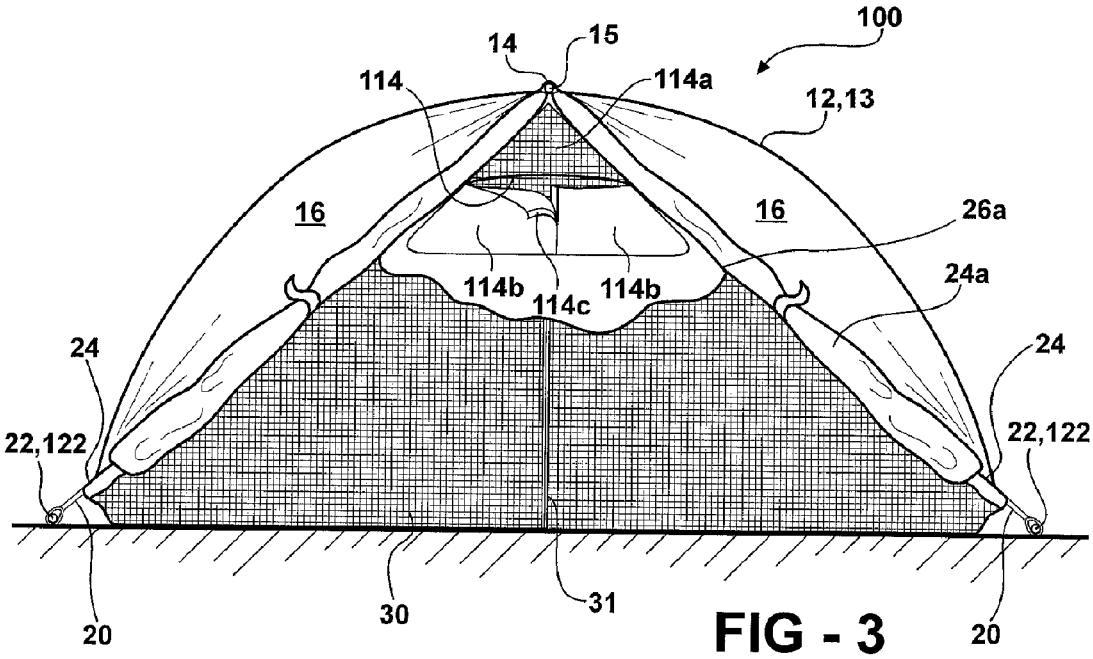
FIG. 3 is a front elevation view of the shelter of FIG. 1, with the front wall screen door partially cut away to show a window in the rear wall.

Referring to FIG. 2, shelter 100 is shown in use with generic platform poles 122, for example sticks found at a campsite. FIGS. 2 and 3 also show how the front and rear end walls 24*a* and 26*a* are preferably made from the same waterproof material as canopy 10, with at least the front wall having a closable door for entering and exiting the shelter, and optionally both walls having doors in multi-person models. In the illustrated embodiment, the front wall panel is split into two halves 24*a*, each rollable back toward sidewalls 16 where they can be secured out of the way with ties 24*b* secured to edges 24. The inner edges of doors 24*a* are provided with a closure such as ties or a zipper or mating hook-and-loop fastener strips 24*c*. Other known types of tent door can be used, for example a triangular or circular zip-closed panel in a single front wall panel. The split door halves 24*a* are currently preferred for their simplicity and light weight, and for their ability to be rolled out of the way for views and ventilation, but when the doors 24*a* and/or the halves of any screen door 30 are unzipped or disconnected, some tension at the front of the shelter will be lost until they are closed again. This loss of tension can be prevented with a stakeout loop 24*c* connected to the lower corner of the door flap, allowing the door to be staked out using a piece of cord 24*d* and stake 24*e* as shown in FIG. 2; this also allows one or both door flaps to be held away from the door opening for ventilation while still providing some weather protection and privacy. Other known ways to prevent loss of tension include connecting a tension-maintaining strap between the lower front corners of the shelter, similar to strap 17*c* connecting the ends of arch pole 13 across the middle of the shelter, or using a tensioned floor connected to the canopy, or using a style of door that when open leaves portions of the front fabric panel in tension between the front end connectors 20.

The lower edges 18 of canopy 10 are spaced from the ground when the canopy is raised and tensioned on its arch pole and platform poles, such that the lower perimeter of shelter 100 allows ventilating airflow to reduce condensation on the interior walls. Ventilation can be further improved by adding one or more covered peak vents 114 at one or both ends of peak 14, which vents remain open but protected from rain when the front door is closed. As best shown in FIG. 3, a preferred peak vent construction uses a waterproof overhang or eyebrow 114 of canopy material, preferably stiffened with a flexible wire or strip along its lower edge, an inner screen backing 114*a*, and a split partial closure comprising two separable flaps 114*b* secured at their separable edges with hook and loop material 114*c*. For insect protection, a screen door 30 on front wall 24 and screened edges 32 along sides 18 preferably extend to at least ground level. Rear wall 26*a* may be another screened door similar to 24*a* and 30, or a solid panel of waterproof canopy material with or without a window such as 26*b* shown in FIG. 3.

Although the lower edges of canopy 10 are raised off the ground when tensioned on its arch pole and platform structure, it will be understood that flaps could be provided around the lower perimeter of the canopy to close off the ventilation gaps or screen, or that a bathtub style floor could be added to seal the shelter around its lower edges. Any screen such as 30 and 32, or any floor attached to the screen or the canopy, will generally be free-hanging or at least spaced inwardly from edges 18, although screen and floor options may make use of the canopy tension through elastic connections and the like to keep the floor or screening from bunching up. It would also be possible to run connections from a floor out to the platform poles.

Figure 2A:
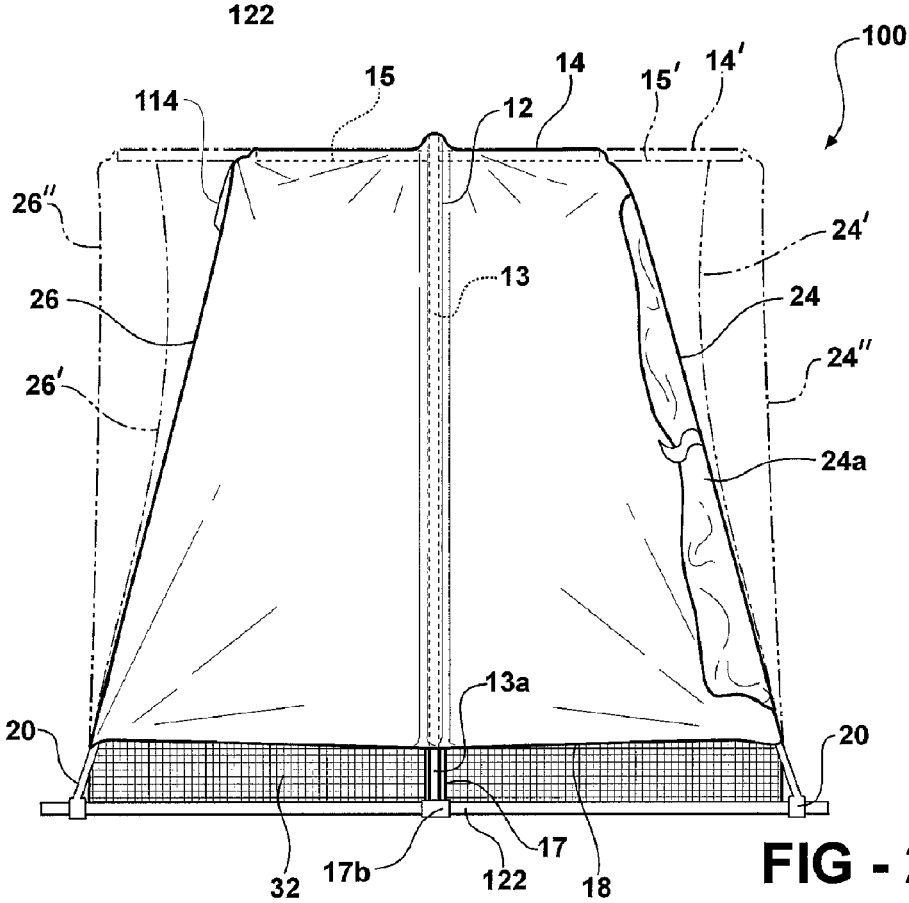
FIG. 2A is a side elevation view of the shelter of FIG. 1, with a preferred roof strut length and front and rear wall angles in solid lines and optional roof strut length and front and rear wall angles in phantom lines.
Figure 4:
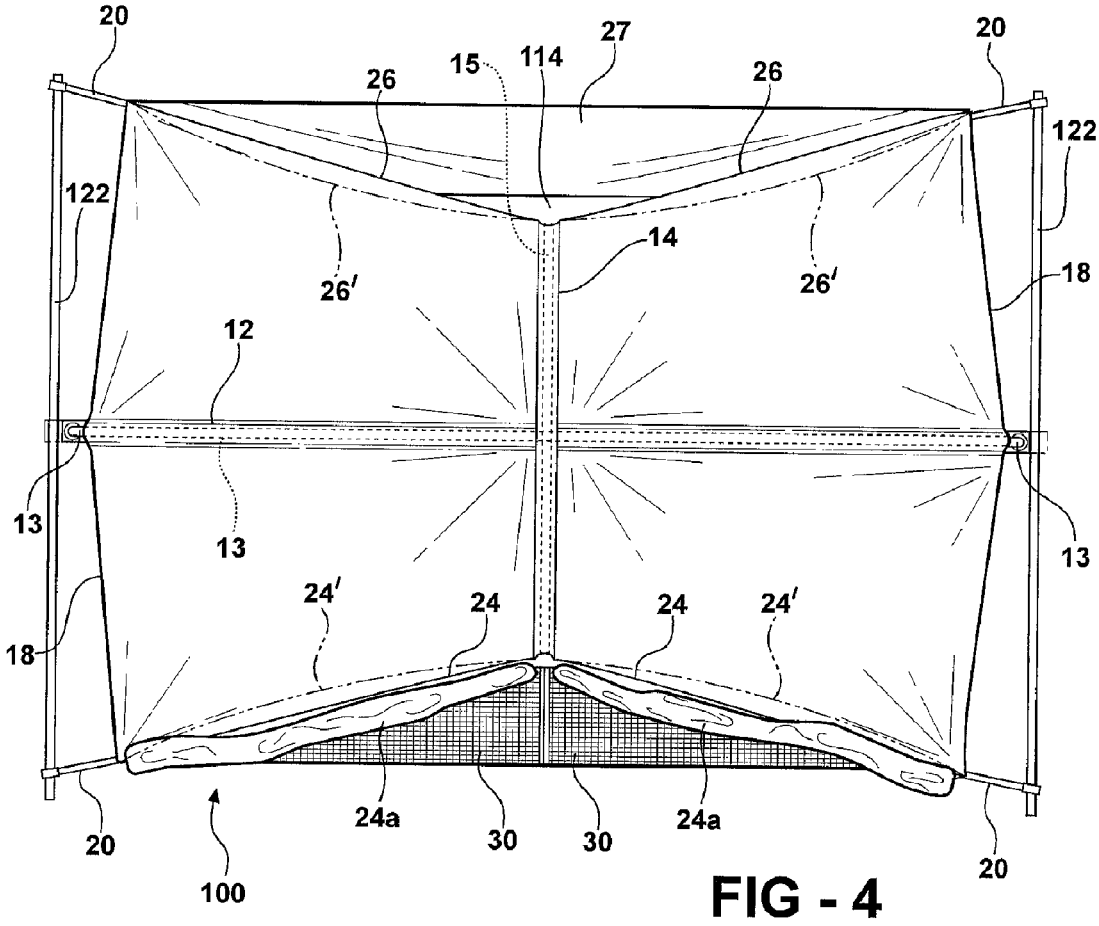
FIG. 4 is a top plan view of the shelter of FIG. 1.

Referring next to FIGS. 2A, 3, and 4, the arched canopy roof 10 ends at generally planar front and rear ends defined by edges 24 and 26. Front and rear edges 24 and 26 are preferably generally triangular in shape, narrowing toward roof strut 15. Roof strut 15 preferably has a length less than the front-to-back depth of shelter 100 measured at the ground-level footprint, such that front and rear tensioned canopy edges 24 and 26 are angled inwardly from the base of the canopy toward the ends of the roof strut as shown in solid lines in FIG. 2A. FIG. 2A also shows an alternate geometry (phantom lines), in which roof strut 15' extends to a width corresponding to that of the shelter footprint, such that front and rear tensioned edges 24" and 26" are vertical. It may even be possible to extend the roof strut beyond the footprint of the shelter, with outwardly-leaning front and/or rear canopy edges and walls, although canopy tension and structural stability are likely to be reduced. It will be understood that the acute, inward-leaning angle of edges 24 and 26 is highly preferred, as it places a constant, balanced, opposing tension on the arch-supported canopy through the platform poles. Vertical or outwardly-angled canopy edges such as 24" and 26" will tend to be less stable. Another tension-enhancing feature that can be used to improve the stability of a canopy with acutely-angled front and rear edges 24 and 26, or to offset the instability of vertical or obtuse edges 24" and 26", is the optional but preferred use of catenary curvature for the front and rear edges as shown at 24' and 26' in FIGS. 2 and 2A and elsewhere in the Figures. Catenary curvature can also be applied to lower side edges 18, as will be understood by those skilled in the art.

It will also be understood that while ends 24 and 26 are preferably closed or closeable walls with canopy panels for weather protection, it is also possible to leave one or both ends open, or covered only with screen, depending on the intended use of the shelter and the angle of ends 24 and 26.

The inwardly-leaning angle of front and rear walls 24*a* and 26*a* is highly preferred due to the beneficial tension created on canopy sidewalls 16 between arch pole 13 and the front and rear edges 24 and 26 of the shelter. As best shown in FIG. 3, the canopy fabric at 16 is tensioned with a concave curvature that grows steeper toward the corner connectors 20, which pulls the canopy in tension between the ends of roof strut 15 and the ends of platform poles 122. This curvature steepens the sidewalls 16 while maintaining good wind-shedding characteristics. Again, the tautness of the canopy fabric between these tension points can be increased with appropriate catenary curvature of the fabric edges at 18, 24, and 26.

The tensioned structure given to the fabric canopy by arch pole 13 and platform poles 122 is perhaps best shown in FIG. 4. The tension exerted by the canopy fabric on the ends or tips of the platform poles 122 through corner connectors 20 tries to bend poles 122, which bending is resisted by the tension of arch pole 13 acting through connectors 17*b* connected to the middle of poles 122.

The tensioned canopy structure of shelter 100 as shown in FIGS. 1 through 4 is essentially symmetrical, with arch pole 13 evenly bisecting canopy 10. While a symmetrical tensioned canopy is preferred, it is possible to tension the canopy in asymmetric fashion, although the canopy is likely to lose some tautness on at least one side of the arch as a result. It will also be understood that while a symmetrical and rectangular footprint is preferred, with the platform poles connected to the canopy in parallel, variations in the shape of the area covered by the canopy are possible. For example, while FIG. 4 shows a generally rectangular footprint covered by the shelter, the presence or absence of front and/or rear end panels, differences in set-up tension, the addition of fabric vestibules or beaks to the front and rear ends that need to be guyed or staked out for maximum volume, and other variations can cause changes in the actual shape of the area covered by the canopy. And it will be further understood that non-rectangular or asymmetric based shelters are also possible, for example with canopies cut to be tensioned between two non-parallel platform poles for a trapezoidal footprint, or canopies cut for use with more than two platform poles.

While shelter 100 is freestanding when set up as shown in FIGS. 1 through 4, it will usually be desirable to stake the lightweight shelter down to keep it from being moved by the wind. This can be accomplished several ways, for example by staking platform poles 22,122 to the ground, or by providing stake loops in platform connectors 20, or by providing stake loops and pullouts for guylines at various places on canopy 10 or even on the screened portions. These and other techniques for staking down a freestanding shelter will be apparent to those skilled in the art.

Figure 5:
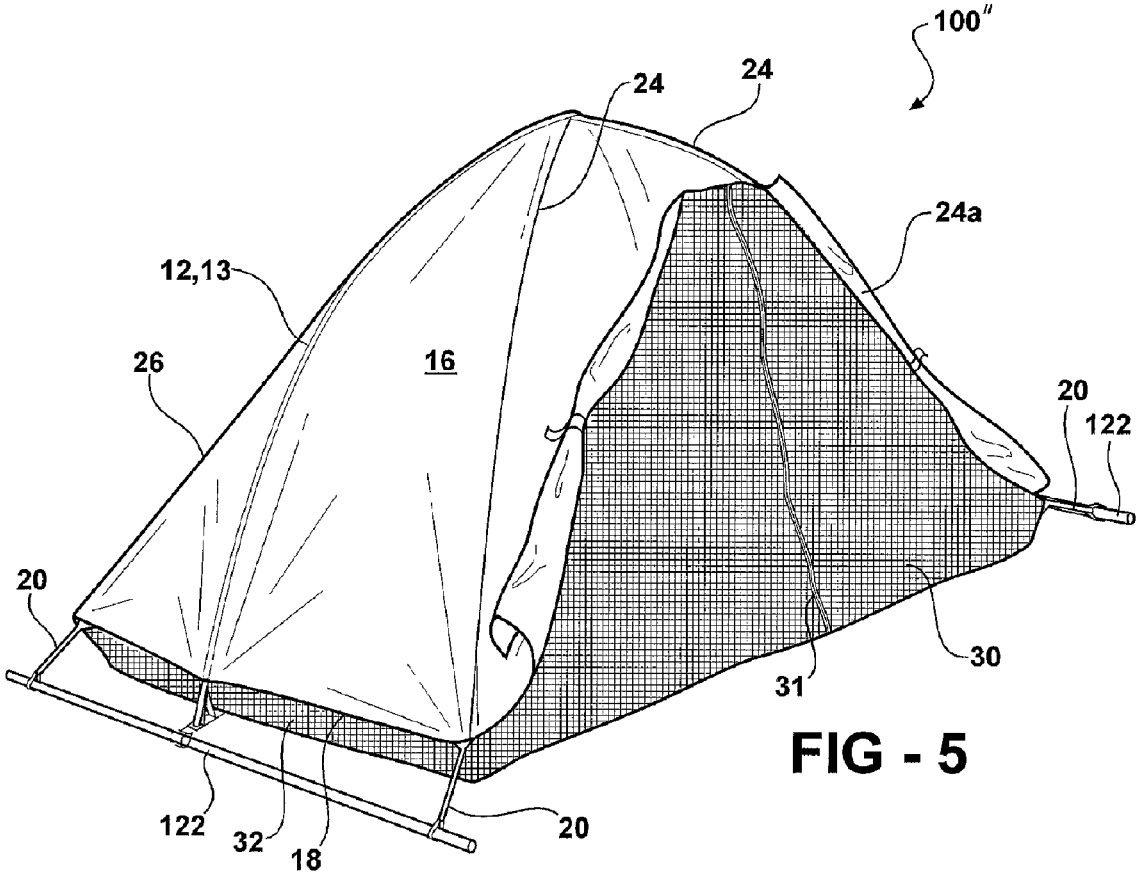
FIG. 5 is similar to FIG. 1, but shows a modified shelter with no roof strut.

FIG. 5 illustrates a modified shelter 100", similar to shelter 100 but without a roof strut. While the roof strut embodiment of FIGS. 1-4 is preferred, it is possible to cut the canopy fabric to be used with only arch pole 13 and no roof strut 15, while maintaining good canopy tautness from front to back, especially with appropriate catenary curvature, but the angle of the front and rear walls relative to vertical will be increased, reducing headroom. Even the strut-using shelter 100 of FIGS. 1-4 could be temporarily used without its strut in a pinch, but stability would be significantly compromised and the front and rear ends would flap in the wind.

Figure 6:
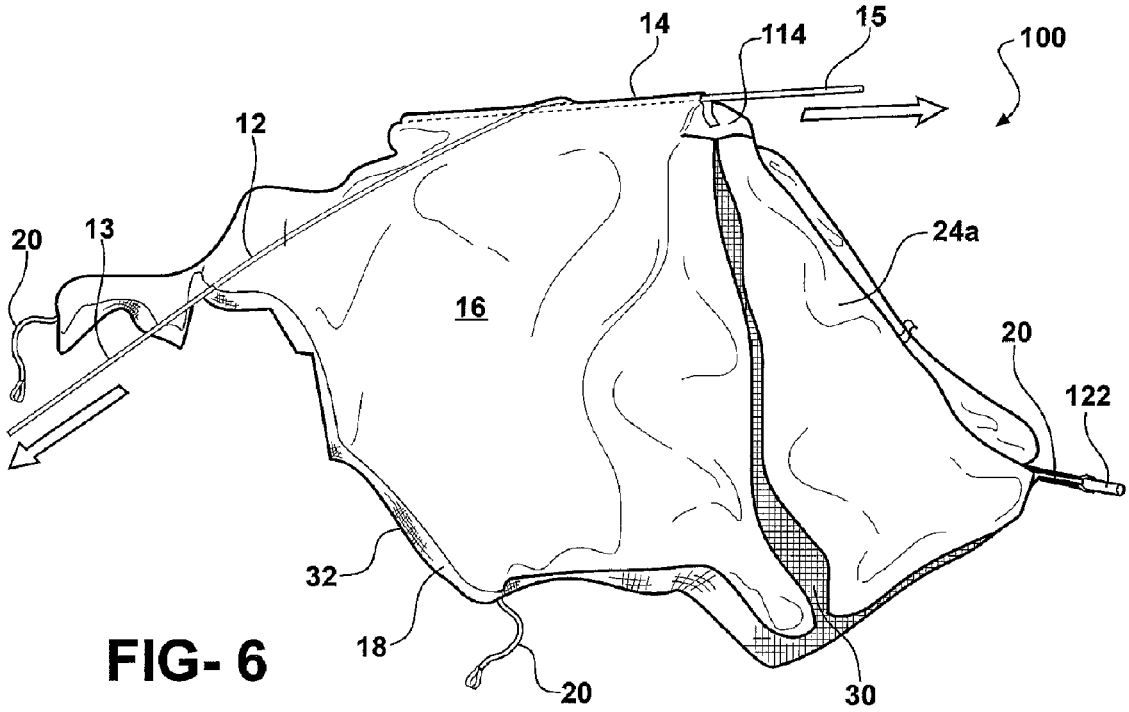
FIG. 6 is a front perspective view of the shelter of FIG. 1, showing the shelter in a partially assembled (or partially disassembled) state.

Referring to FIG. 6, shelter 100 is easily disassembled by simply disconnecting arch pole ends 13*a* from grommets 17*a*, removing pole 13 from sleeve 12, releasing platform connectors 17*b* and 20 from poles 122, and optionally removing roof strut 15 from sleeve 14. Pole 13 is preferably made from sections connected by an elastic shock cord in known manner, and in the illustrated example has an approximate 12-foot length when assembled.

The floor space or covered area or footprint of shelter 100 will depend on the length of available platform poles. Most trekking poles are limited in length, and by way of example the illustrated shelter 100 has a front to back floor depth of approximately 44" to 50" inches, a roof strut length of approximately 18" inches, a height of approximately 45" inches, and a width between side edges 18 of approximately 100" inches, and is intended as a one or two person shelter. It may be possible to make shelter 100 with a depth sufficient for more people, limited only by the length of available platform poles and practical weight considerations. It may be desirable in some cases to make roof strut 15 a telescoping pole or rod, for example to tension ventilation peaks such as 114, or to accommodate deeper floor plans when extended yet be collapsible within peak sleeve 14 for storage.

Figure 7:
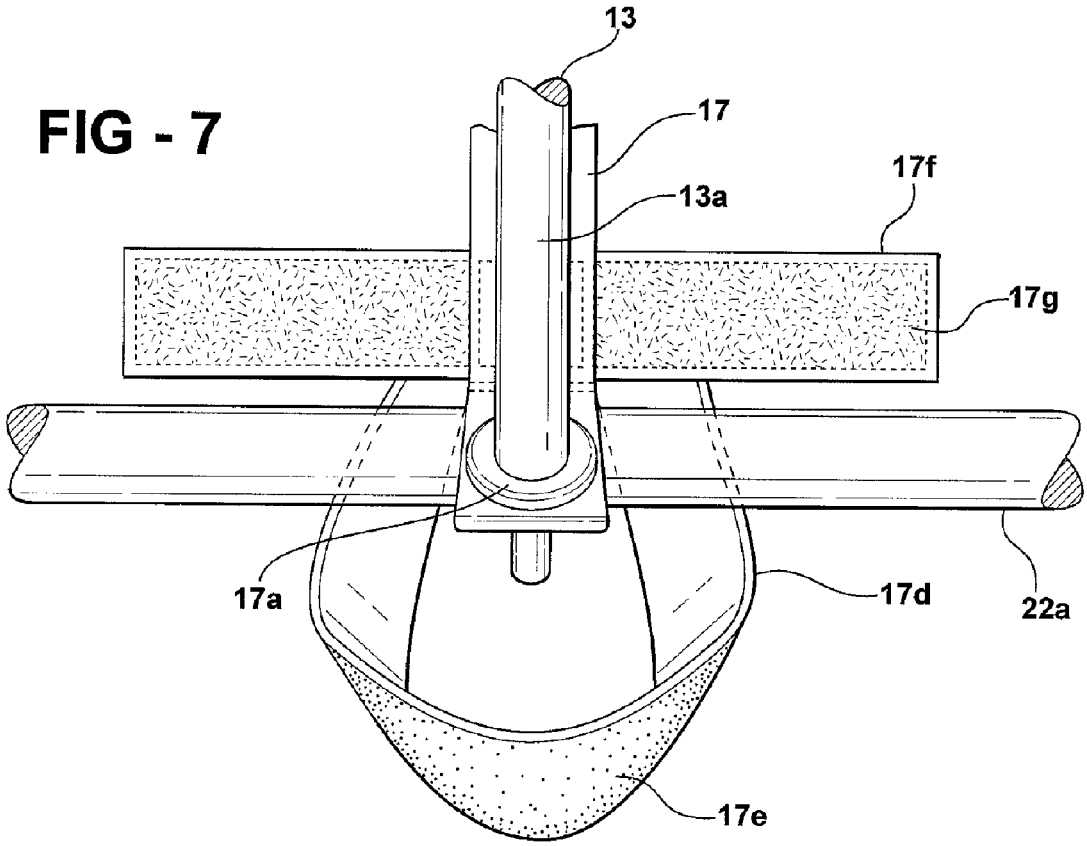
FIGS. 7 and 7A are detailed perspective views of a preferred connector strap structure for the shelter's arch pole.
Figure 7A:
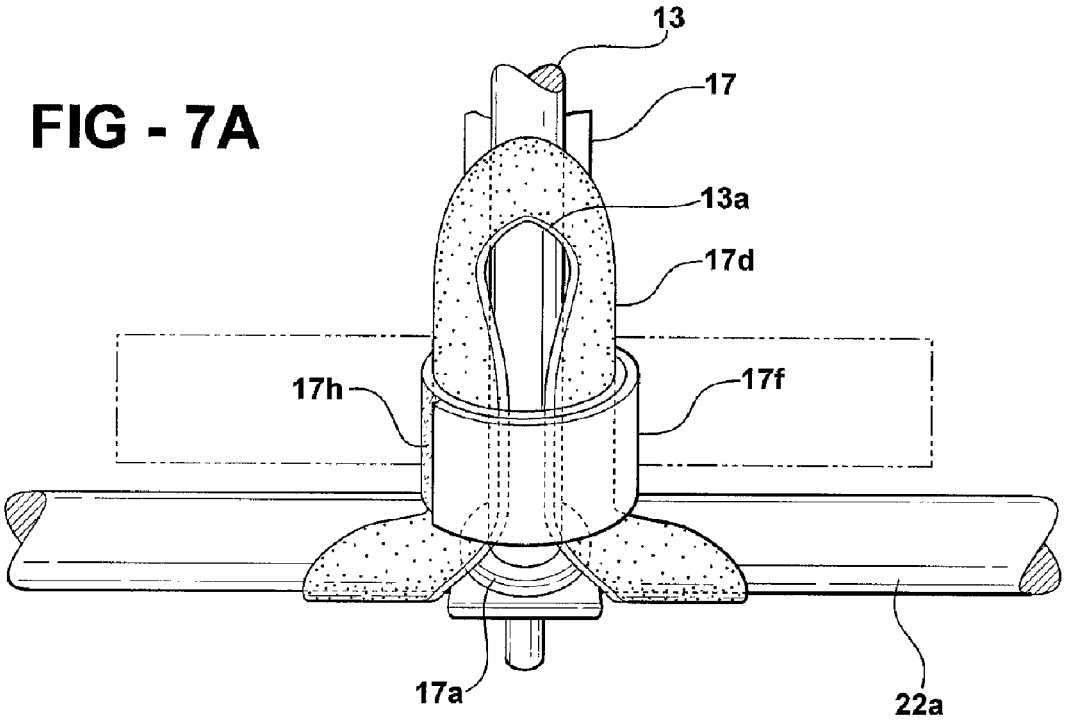

FIGS. 7 and 7A illustrate a preferred connector strap structure for locking the ends of arch pole 13 in tension to platform pole 22*a*. A loop 17*d* of strap material, such as nylon webbing, is secured at its inner end to the back of vertical strap 17 or to cross-strap 17*c* (not shown, see FIGS. 1-4), for example by sewing. A horizontal wrap-strap 17*f* is secured in like manner, its free ends positioned to wrap around the exposed end 13*a* of pole 13 above platform pole 22*a*. The outside face of loop 17*d* is faced with hook and loop fastener material 17*e*. The outside face of wrap strap 17*f* is faced with hook and loop fastener material 17*g* that mates with material 17*e* on the loop. The opposite face of wrap strap 17*f* is faced with a hook and loop fastener material 17*h* similar to 17*e*, i.e. it mates with material 17*g*. Loop 17*d* is placed under pole 22*a* as shown in FIG. 7, and then pulled up and around the outside of platform pole 22 and the connection between the tip of arch pole 13 and grommet 17*a* as shown in FIG. 7A. Finally, wrap strap 17*f* is wrapped around loop 17*d* and pole end 13*a* to securely lock the pole tip in the grommet.

It will be understood that the disclosed embodiments are representative of presently preferred forms of the invention, but are intended to be illustrative rather than definitive of the invention. The scope of the invention is defined by the following claims.

I accordingly claim:

1. A freestanding fabric shelter suitable for use by backpackers, comprising: a weather-resistant fabric canopy comprising two side edges adjacent the ground, and front and rear ends; two separate, spaced, generally straight, ground-level platform poles of a length corresponding to the side edges of the canopy; a single flexible arch pole, the arch pole being removably connected at each end to an intermediate portion of one of the platform poles in generally perpendicular relationship to the platform poles, the arch pole further being connected in generally continuous tension to the canopy across an intermediate portion of the canopy from one of the side edges to the other of the side edges; and, platform connectors along the side edges of the canopy removably securing the side edges of the canopy and the ends of the arch pole to the platform poles with the arch pole and intermediate portion of the canopy tensioned into a freestanding continuous arch between the platform poles with the side edges and ends of the canopy extending in tension from both sides of the arch pole.

2. The freestanding shelter of claim 1, wherein the platform poles are trekking poles.

3. The freestanding shelter of claim 1, wherein the canopy includes a roof strut secured to the canopy between the ends of the canopy and crossing the arch pole.

4. The freestanding shelter of claim 3, wherein the roof strut is removably secured to the canopy.

5. The freestanding shelter of claim 3, wherein the canopy has an arched roof portion and generally planar front and rear ends, and the front and rear ends are generally triangular and extend from ends of the roof strut.

6. The freestanding shelter of claim 5, wherein the roof strut is shorter than a front-to-back depth of a canopy footprint, and the front and rear ends extend from front and back ends of the roof strut at an acute angle.

7. The freestanding shelter of claim 5, wherein the roof strut has a length equal to or longer than a front-to-back depth of a canopy footprint.

8. The freestanding shelter of claim 1, wherein the canopy has an arched roof portion and generally planar front and rear ends.

9. The freestanding shelter of claim 8, wherein the front and rear ends are generally triangular.

10. The freestanding shelter of claim 8, wherein at least one of the front and rear ends is angled inwardly from its lower end toward the arch pole.

11. The freestanding shelter of claim 1, wherein the arch pole is secured in a sleeve on the canopy, and free ends of the arch pole exit open ends of the sleeve adjacent the platform poles, and wherein one of the platform connectors on each side edge of the canopy comprises an arch pole connector connected to the canopy adjacent the sleeve and removably securing the free ends of the arch pole to the platform poles.

12. The freestanding shelter of claim 11, wherein the arch pole connector comprises a closed loop of hook-and-loop material adapted to wrap under one of the platform poles and to lie against the arch pole, and a horizontal strap of hook-and-loop material adapted to wrap around and secure the closed loop against the arch pole.

13. The freestanding shelter of claim 1, wherein the canopy has an arched roof portion and generally planar front and rear ends, and the front and rear ends are generally triangular and extend from a peak portion of the arch pole.

14. The freestanding shelter of claim 1, wherein the ends of the arch pole are connected in tension by a ground-level flexible connector running between them.

* * * * *